US005315361A

United States Patent [19]

Sawada et al.

[11] Patent Number: 5,315,361

[45] Date of Patent: May 24, 1994

[54] PRINTER USING ELECTROSTATIC PROCESS INCLUDING MULTIPLE SHEET DISCHARGE RECEIVERS WITH A PIVOTAL GUIDE AND A FULL TRAY DETECTOR

[75] Inventors: Shigeru Sawada; Shinichi Kasai; Jun Tsujimoto; Masako Yokoyama, all of Nagano, Japan

[73] Assignee: Seiko Epson Corporation, Tokyo, Japan

[21] Appl. No.: 80,595

[22] Filed: Jun. 24, 1993

Related U.S. Application Data

[60] Continuation of Ser. No. 843,713, Feb. 28, 1992, abandoned, which is a division of Ser. No. 528,978, May 25, 1990, Pat. No. 5,141,222.

[30] Foreign Application Priority Data

| | | | |
|---|---|---|---|
| May 26, 1989 | [JP] | Japan | 1-133029 |
| Nov. 30, 1989 | [JP] | Japan | 1-310892 |
| Nov. 30, 1989 | [JP] | Japan | 1-310893 |
| Nov. 30, 1989 | [JP] | Japan | 1-310894 |
| Nov. 30, 1989 | [JP] | Japan | 1-310895 |
| Nov. 30, 1989 | [JP] | Japan | 1-310896 |

[51] Int. Cl.[5] ..... G03G 21/00

[52] U.S. Cl. ..... 355/323; 271/176; 271/258; 271/296; 271/302; 355/206

[58] Field of Search ..... 355/206, 308, 316, 321, 355/323; 271/176, 256, 258, 280, 287, 296, 298, 302; 346/134

[56] References Cited

U.S. PATENT DOCUMENTS

| | | | |
|---|---|---|---|
| 4,548,403 | 10/1985 | Matsui et al. | 271/302 X |
| 4,684,235 | 8/1987 | Kohmoto et al. | 355/316 |
| 4,822,025 | 4/1989 | Chung | 271/296 |
| 4,830,357 | 5/1989 | Goto et al. | 271/296 X |
| 4,830,358 | 5/1989 | Fazio et al. | 271/296 X |

FOREIGN PATENT DOCUMENTS

| | | | |
|---|---|---|---|
| 58-37662 | 3/1983 | Japan | 355/323 |
| 2224011 | 4/1990 | United Kingdom | 355/323 |

*Primary Examiner*—Benjamin R. Fuller
*Assistant Examiner*—J. E. Barlow, Jr.
*Attorney, Agent, or Firm*—Cushman, Darby & Cushman

[57] ABSTRACT

A printer with a sorter unit allows printed recording sheets to be sorted to a single tray selected from a plurality of trays by a recording sheet guide mechanism that pivots around a shaft. Thus, the printer can sort the printed sheets by page, by user, or discharge the printed sheets paginated or with the printed side facing upward. The sorter trays includes a first detection lever that is rotated by the weight of recording sheets and a second detection lever that rotates in association with the first detection lever. A lever detector is provided on the sorter guide to detect the movement of the second detection lever. The sorter or guide is also provided with a sheet detection lever to detect a jam in the sorter guide.

1 Claim, 16 Drawing Sheets

PRINTER USING ELECTROSTATIC PROCESS INCLUDING MULTIPLE SHEET DISCHARGE RECEIVERS WITH A PIVOTAL GUIDE AND A FULL TRAY DETECTOR

This is a continuation of application Ser. No. 07/843,713, filed on Feb. 28, 1992, which was abandoned upon the filing hereof which was a DIV. Ser. No. of 07/528,978, filed May 25, 1990, now U.S. Pat. No. 5,141,222.

BACKGROUND OF THE INVENTION

1. Field of the Invention

This invention relates to a terminal printer utilizing an electrophotographic process, and more particularly to a printer having a mechanism for handling printed sheets.

Terminal printers utilizing the electrophotographic process can produce printed materials with such a high printing quality that they are in some cases used in publishing materials in small number of copies or shared by a plurality of personal computers.

In printing a small number of copies, functions such as double-side printing and sorting of printed sheets by page are in demand.

To share the printer with a plurality of users, it is required that printed copies be sorted and compiled by user.

For this reason, a sorter of such structure as to be used in copying machines is sometimes mounted at the recording sheet discharge outlet of the printer. More specifically, a sorter guide member connectable to the recording sheet discharge outlet of the printer is provided; a second sorter guide member that rises upright is connected to an end portion of this sorter guide member; and a plurality of horizontal windows are provided at a predetermined interval on the second sorter guide member, and these windows accommodate gate members each being operated by a drive member.

In such a sorter, in which a gate member is arranged per tray and the tray must be selected by the gate member, thereby requiring a drive mechanism per gate member. Thus, the printer structure becomes large.

Also, in order to respond to a demand for facedown discharging in which printed sheets are discharged as paginated and for faceup discharging by which the printed face can be checked, a path for causing a recording sheet to make a U-turn on the upper surface of a housing at the recording sheet discharge outlet is provided thereby to allow the path to be selected according to the discharge mode. However, this requires that printed materials be placed wide apart, one in the upper part and the other in the lower part, thereby causing confusion in handling recording sheets.

SUMMARY OF THE INVENTION

A first object of the present invention is therefore to provide a printer having a paper handling mechanism suitable for handling printed sheets in various manners.

A second object of the present invention is to provide a printer having a paper handling mechanism which does not interfere with the execution of maintenance work on a printer whose printing path is arranged vertically.

The above objects has been attained by the provision of a printer comprising: means for discharging a recording sheet that has been printed by the electrophotographic process, said discharge means having a recording sheet discharge outlet; a plurality of sorter trays for receiving a plurality of recording sheets that have been printed; sorter guide means for guiding a recording sheet from said discharging means to said sorter trays and for discharging said recording sheet to said sorter trays; and means for switching sorters by guiding said sorter guide means to a position of a desired one of said sorter trays; wherein said sorter guide means is pivotably supported by said sorter switching means, and the center of rotation of said sorter guide means is arranged near said recording sheet discharge outlet of said discharge means.

BRIEF DESCRIPTION OF THE DRAWINGS

FIGS. 6, 7, and 8 show the operation of the printer, of which FIG. 6 is a diagram showing the location of the sorter guide member when a plurality of trays are used as sorting shelves or mail boxes; FIG. 7 is a diagram showing the location of the sorter guide member when a recording sheet is discharged faceup; and FIG. 8 is a diagram showing the location of the sorter guide member when the recording sheet is guided to print on the rear face for double-side printing;

FIGS. 23, 24, and 25 respectively show a recording sheet guide unit capable of discharging not only a normal sheet but also a thick sheet discharged from the printer body either faceup or facedown, of which FIG. 23 is a diagram showing the case where a facedown discharge mode is selected; FIG. 24 is a diagram showing the case where a faceup discharge mode is selected; and FIG. 25 is a diagram showing the case where a thick sheet discharge mode is selected.

DETAILED DESCRIPTION OF THE PREFERRED EMBODIMENTS

Figure 1:
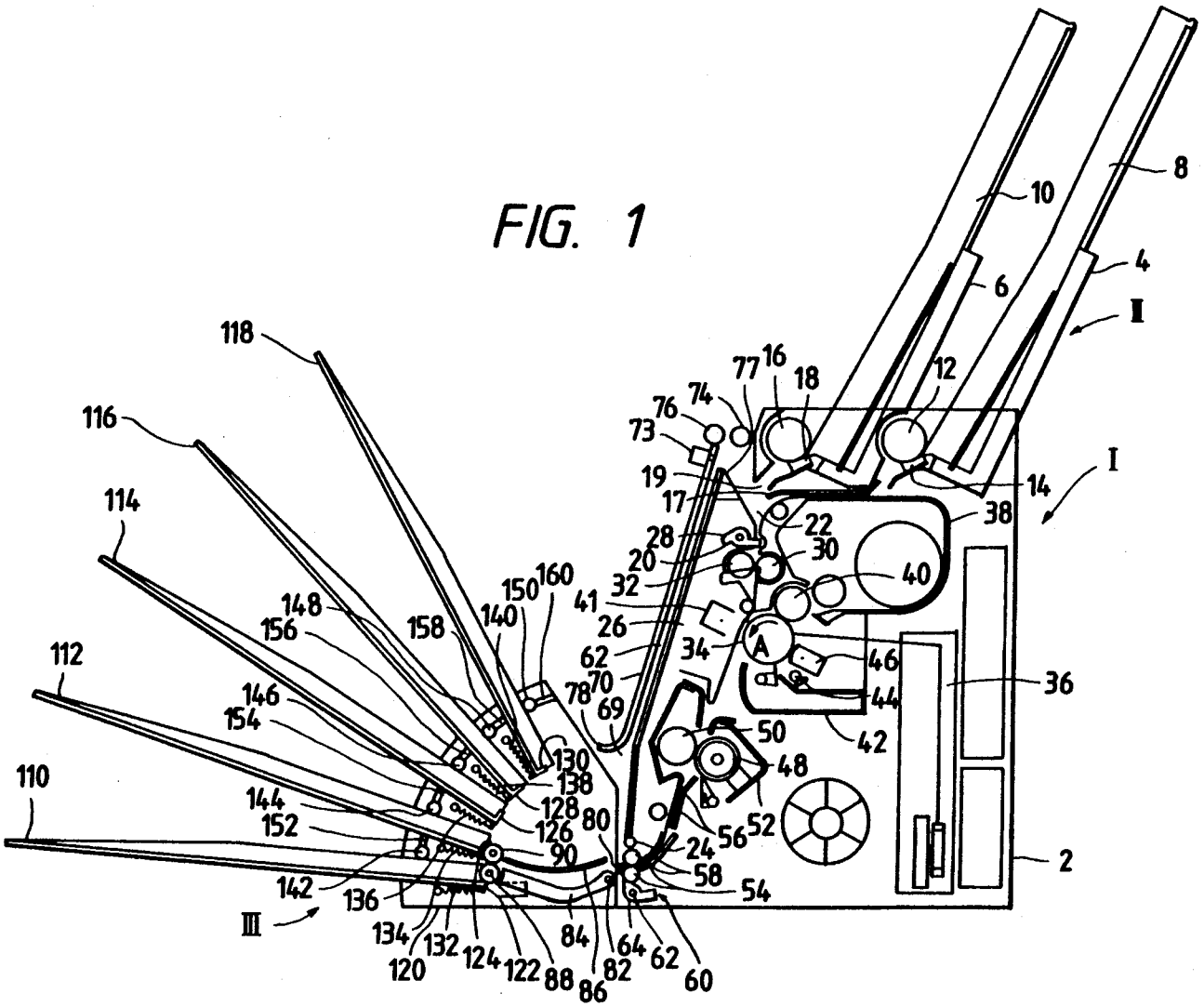
FIG. 1 is a sectional view of a printer that is an embodiment of the present invention.

FIG. 1 shows an embodiment of the present invention, in which a printer body designated by reference numeral I has its printing path arranged substantially vertically, and on the top of a housing 2 doubling as a dark box is a recording sheet feeder unit II for holding recording sheets of difference size substantially vertically in locations toward and away from the operator of the printer.

The recording sheet feeder unit II comprises stackers 4 and 6 for holding the recording sheets substantially vertically, recording sheet take-out rollers 12 and 16 and pads 14 and 18, disposed in contact with the bottom of the stackers, for taking out recording sheets 8 and 10 one by one.

The recording sheets taken out from the recording sheet take-out rollers 12, 16 enter a recording sheet feed inlet 22 on the upper end of a printing path 20 from discharge outlets 17 and 19.

The printing path 20 comprises the housing body 2 and a cover member 26 that is pivotable by a horizontal pivot shaft 24 at the bottom of the housing body 2 and is constructed so that it allows easy maintenance by opening the cover member 26 with the printing path 20 as a boundary to expose the front of the housing body 2.

Immediately below the recording sheet feed inlet 22 is a recording sheet detector 28, and below the recording sheet detector 28 are gate rollers 30 and 32, arranged on both the housing body 2 side and the cover member 26 side, for forwarding the recording sheet further downward after the head end of the sheet has been positioned.

In the figure, a photosensitive drum designated by reference numeral 34 is arranged on the housing body 2 side. The photosensitive drum 34 serves to form a latent image by receiving an optical beam that has been modulated by printing data using an optical signal generator 36, while rotated in the direction of reference character A. The latent image is converted into a permanent image by a toner sleeve 40 of a developing unit 38, transferred onto the recording sheet that has moved along the printing path 20 by a transfer unit 41 thereby to form a toner image on the recording sheet. Below the photosensitive drum 34 are a cleaning unit 42 for recovering the toner that has been left untransferred, an erase lamp 44 for discharging the electric charges remaining on the photosensitive drum 34, and a charging unit 46 for conferring initial charges to the photosensitive drum 34.

Below the photosensitive drum 34 is a fixing unit 52 comprising a heating roller 48 and a pressure roller 50 so as to interpose the printing path 20 therebetween.

Further below these are discharge guide members 56 and 58 for guiding the printing sheet to discharge rollers 54. The end portion of the discharge rollers 54 is provided with a sheet detector 60 for detecting the arrival of the recording sheet at a predetermined position. The sheet detector 60 is normally biased so that will protrude toward a discharge path, and comprises a lever 64 that retracts from a sheet forwarding path by rotating around a shaft 62 when the recording sheet is abutted against the sheet detector 60 and a switch not shown that converts the movement of the lever 64 into an electric signal.

On the other hand, on the front side of the cover member 26 (left as viewed in the figure) is provided a guide board 70 forming a recording sheet guiding path 68 to guide the recording sheet upward. The guide board 70 has not only its lower end extended to such a position as to allow the head end of the recording sheet to be guided to the printing path 68 by an end portion of a sorter guide member (described later), but also its upper end extended so as to be higher than the sheet feed inlet 22. Also, in the vicinity of the upper end of the guide board 70 is a recording sheet tail end detector 72 for detecting the tail end of the recording sheet and on the upper portion of the guide board 70 are take-out rollers 74 and 76 for taking the recording sheet upward.

The lower end of the guide board 70 is provided with a sheet receiving member 78 for supporting the bottom end of the recording sheet.

A sorter unit indicated by reference character III comprises sorter guide members 84 and 86 having a rotary shaft 82 adjacent to a discharge outlet 80 of the printer body I. On the end portions of the sorter guide members are provided with sheet forwarding rollers 88 and 90 for discharging the recording sheet. It is constructed so that one of the sheet forwarding rollers 88 receives a rotary force from the discharge rollers 54 through a transmission mechanism such as a timing belt or the like.

Figure 2:
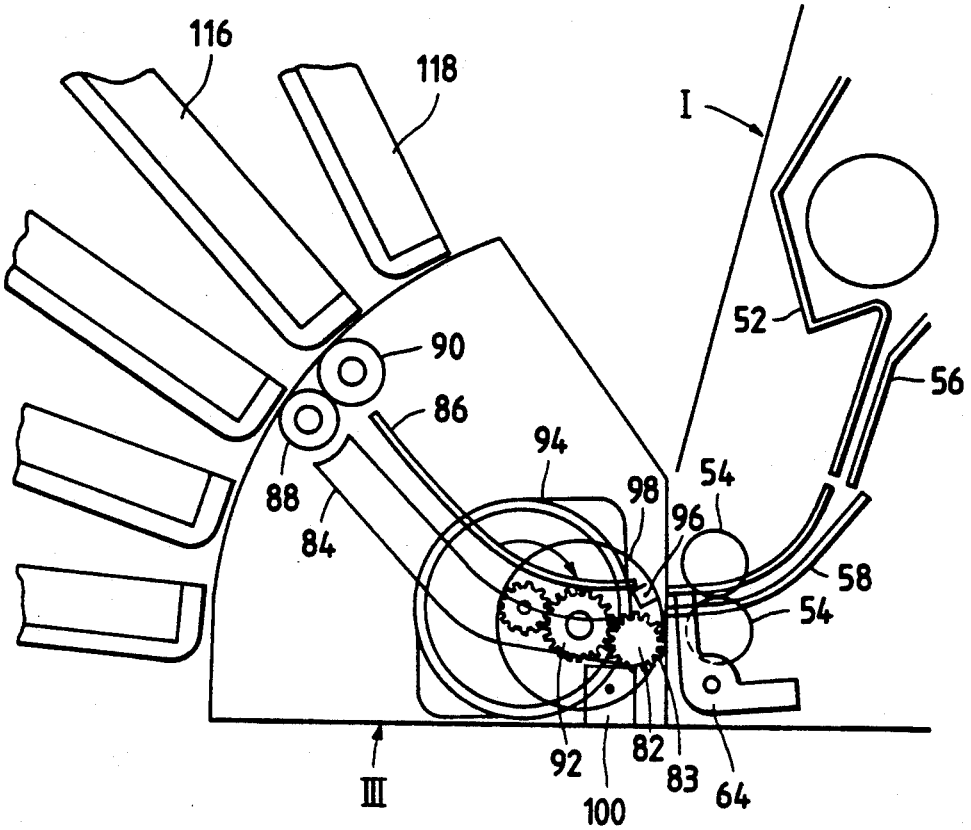
FIG. 2 is a sectional view showing the main portion of a recording sheet handling mechanism.
Figure 4:
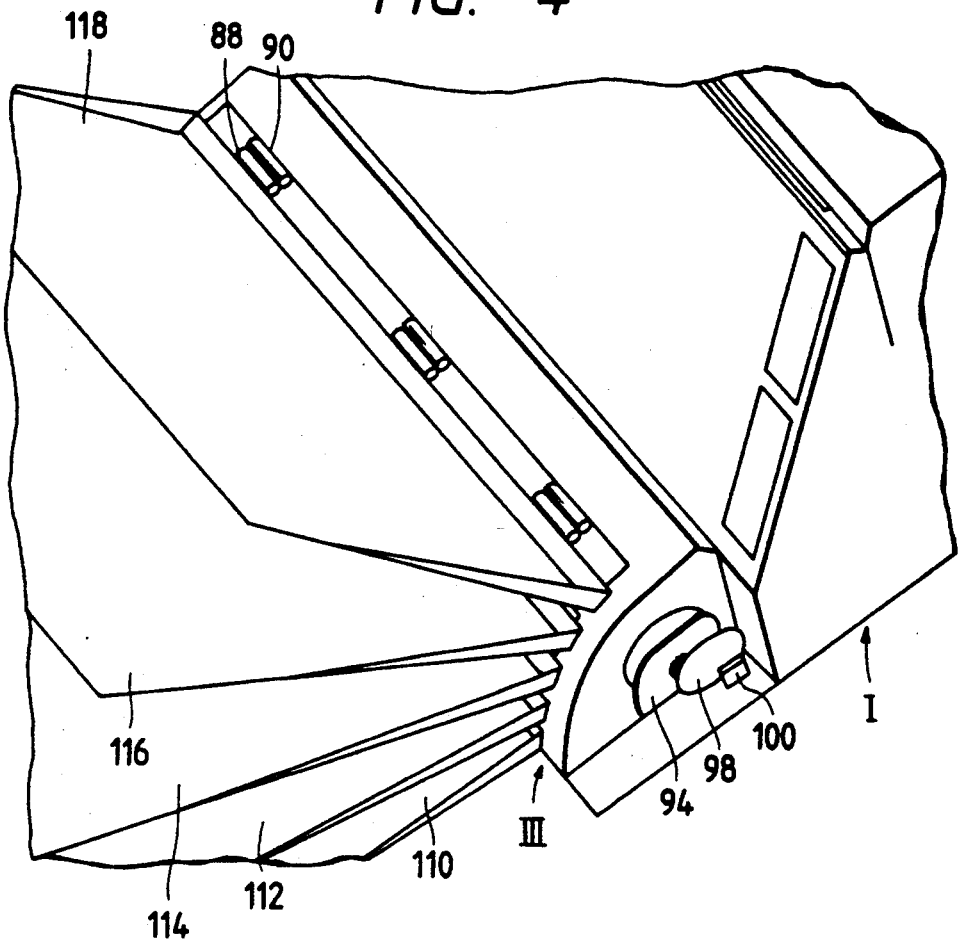
FIG. 4 is a perspective view showing the drive unit of the sorter guide member with its cover removed.

The sorter guide members 84, 86 have a gear 83 secured to the rotary shaft 82, and as shown in FIG. 2, are connected to a pulse motor 94 through a gear 92 so as to be rotatable from the bottommost position (as shown in FIG. 1) to a position connecting the recording sheet guiding path 68. On the rotary shaft of the gear 92 is a light shielding board 98 with a through hole 96 provided, forming a position detector having a photodetector 100 such as a photointerrupter for detecting the through hole 96 (see FIG. 4).

Figure 3:
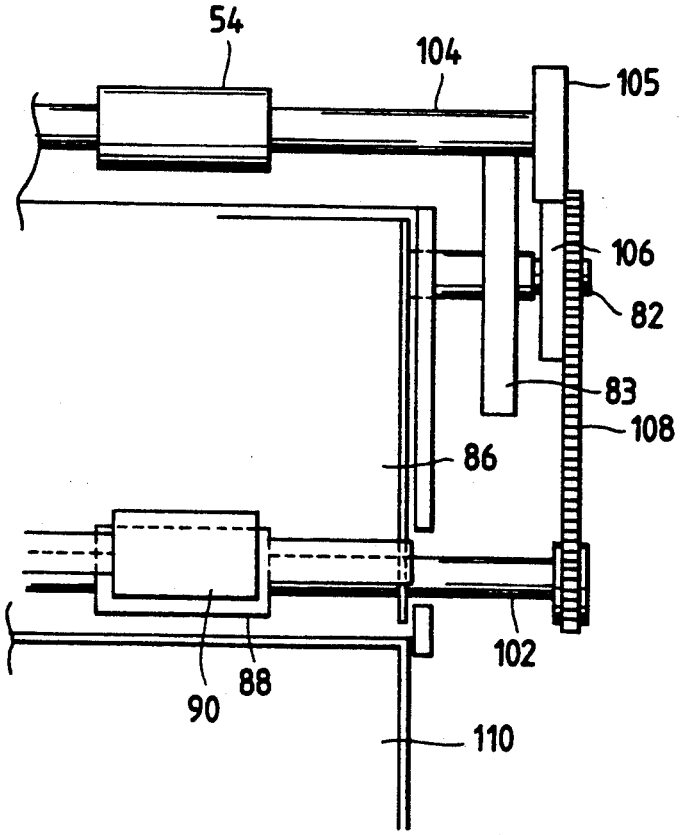
FIG. 3 is a top view for showing the drive force transmission system between a sorter guide member and a printer body.

One of the take-out rollers 90 provided on the end portion of the sorter guide members 84, 86 is constructed so that, as shown in FIG. 3, a rotary shaft 102 of the take-out roller 90 is connected by a gear 106 engaged with a gear 105 and a timing belt 108 thereby to be driven by the rotation of the discharge rollers 54.

Returning to FIG. 1, on the end portion side of the sorter guide members 84, 86 are recording trays 110, 112, 114, 116, and 118 arranged at an equal distance radially. The root ends of these recording trays 110 through 118, i.e., the recording sheet entrance side, are mounted rotatably on a base frame 120 by rotary shafts 122, 124, 126, 128, and 130. Tension springs 132, 134, 136, 138, and 140 stretched to the base frame 120 maintain a predetermined distance by being in contact with angle-adjusting shafts 142, 144, 146, 148, and 150, while the trays 110 through 118 are pivoted when pressed downward by an external force. These angle-adjusting shafts 142 through 150 are removably provided on tray selection shaft holes 152, 154, 156, 158, and 160 formed on the base frame 120, allowing the distance between the trays to be adjusted by changing the insertion position of the angle-adjusting shafts 142 through 150.

Figure 5:
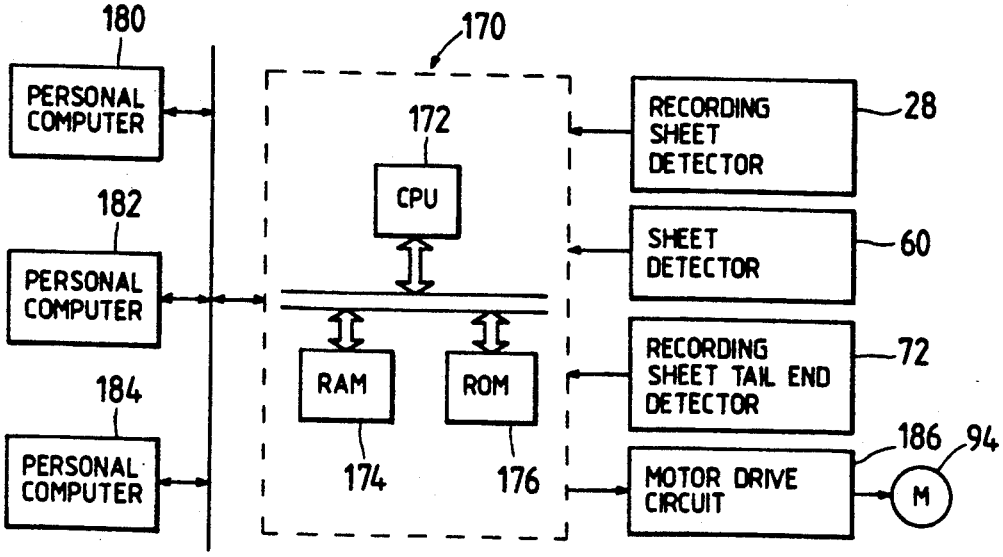
FIG. 5 is a block diagram showing an embodiment of a control unit for controlling an operation of the printer.
Figure 6:
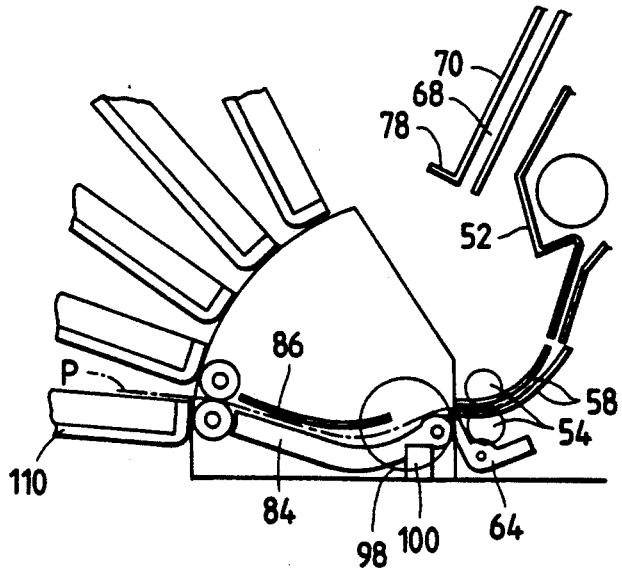

FIG. 5 shows an embodiment of a control unit for controlling the operation of the above printer. In the figure, a printer control unit designated by reference numeral 170 consists of a microcomputer having a CPU (central processing unit) 172, a RAM (random access memory) 174, a ROM (read only memory) 176. The control unit has a program for not only performing a normal printing control to print data on a recording sheet by receiving inputs of printing data from a plurality of personal computers 180, 182, 184, and so on but also driving the pulse motor 94 through a motor drive circuit 186 upon reception of signals from the sheet detector 60, the photodetector 100, and the recording sheet tail end detector 72 to control the pulse motor 94 that drives the sorter guide members 84 and 86 (see FIG. 2) to sort printed sheets according to the purpose.

An operation of the printer thus constructed will now be described.

A plurality of host units are connected to the printer body I. Upon instruction of a printing command from one of the host units, the printer body I takes out a sheet of recording paper from the recording sheet feeder unit II and feeds the sheet to the recording sheet feed inlet 22 on the printing path. Upon output of a signal from the recording sheet detector 28, the photosensitive drum 34 and the optical signal generator 36 start operating conjointly to form a latent image corresponding to the printing data on the photosensitive drum 34. The developing unit 38 then causes the latent image to be converted to a toner image, and the recording sheet is forwarded to the transfer unit 41. In synchronism with this operation the recording sheet is forwarded from the gate rollers 30, 32. When the toner image formed on the photosensitive drum 34 confronts with the recording sheet in this way, the toner on the photosensitive drum 34 is attracted to the recording sheet by an electrostatic force of electric charge developed by the transfer unit 41, thereby transferring the toner image onto the recording sheet. The recording sheet passing through the photosensitive drum 34 enters the fixing unit 52, where the toner adhering to the surface of the recording sheet is thermally fixed onto the recording sheet by receiving heat from the heating roller 48 and the force from the pressure roller 50.

The recording sheet exited from the fixing unit 52 further moves toward the discharge rollers 54 guided by the discharge guide members 56, 58. Upon arrival of the recording sheet at a predetermined position in this way, the lever 64 is activated to pivot by being pressed by the recording sheet, and the sheet detector 60 in turn applies a signal.

This signal causes the printing control unit to drive the pulse motor 94 (FIG. 2) thereby to rotate the sorter guide members 84, 86 in a predetermined direction, e.g., toward the bottommost position. As a result, the light shielding board 98 is pivoted so as to follow the above rotation, and when the light shielding board 98 arrives at a predetermined position the through hole 96 confronts with an optical path. Accordingly, the photodetector 100 applies a signal to stop the pulse motor 94 and the recording sheet guide members 84, 86 are set to a standard position, e.g., a position confronting with the first tray 110. Under this condition, the recording sheet guide members 84, 86 are pivoted to a position instructed by the printing control unit so that a tray for accommodating the recording sheet that is being printed will be selected.

On the other hand, the recording sheet that has reached the discharge outlet 80 is guided by the sorter guide members 84, 86 and the head end of the recording sheet reaches the discharge rollers 88 and 90. The discharge rollers 88, 90 are rotated by a driving force from the discharge rollers 54, 54 by the timing belt 108 and forward the recording sheet to the tray 110.

When a second page of the recording sheet is printed and forwarded to the discharge rollers 54, 54, the printing control unit causes the sorter guide members 84, 86 to the second tray 112 by driving the pulse motor 94 for a predetermined number of steps. Accordingly, the recording sheet discharged from the discharge outlet 80 is discharged to the second tray 112 guided by the recording sheet guide members 84, 86.

The sorting of the subsequent printed sheets is performed by rotating the sorter guide members 84, 86 according to the number of pages.

By the way, in the case where the printer is shared by a plurality of users, mixture of printed materials of each user can be prevented by assigning the trays 110 through 118 to each of the users.

That is, the first tray 110 is assigned to a first user, the second tray 112 to a second user, and so on. Under this condition, if the first user desires to make a printing, he or she first enters an ID code and then enters the printing data to the printer body I. As a result, the printing control unit continues printing with the sorter guide members 84, 86 positioned at the first tray 110 by driving the pulse motor 94. Accordingly, the recording sheets belonging to the first user are received only by the first tray 110.

If the second user wishes to use the printer, the printer starts operating upon reception of an input of his or her ID. As a result, the printing control unit drives the pulse motor 94 to position the sorter guide members 84, 86 at the second tray 112. Thus, the recording sheet is discharged to the second tray 112 by the guide members 84, 86.

The printed materials of the respective users can be discharged to the trays each assigned to each user, thereby allowing each tray to be used as a mail box dedicated to each user.

Figure 7:
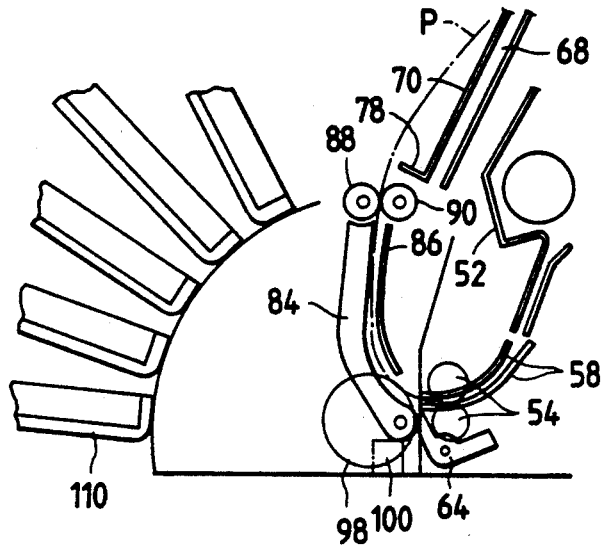

Although, in the above operation, the recording sheet is discharged with the printed side facing downward, in the case where the faceup discharge mode is desired; i.e., the recording sheet is discharged with the printed side facing upward, the discharge rollers of the sorter guide members 84, 86 is set to a position confronting with the faceup tray 70 as shown in FIG. 7 by driving the pulse motor 94.

When discharged from the discharge rollers 54, 54 of the printer body I under this condition, the recording sheet P is guided by the sorter guide members 84, 86 so that the recording sheet P is obliquely upward, the head end of the recording sheet P is pulled out by the discharge rollers 88, 90, and the head end is lifted so as to be slid in contact with the upper surface of the printer body I. When the tail end of the recording sheet P leaves from the discharge rollers 88, 90, the recording sheet P is caught by the sheet receiving member 78 and accommodated therein. Thus, the recording sheet P is received with the printed side facing upward, i.e., left side as viewed in the figure.

Figure 8:
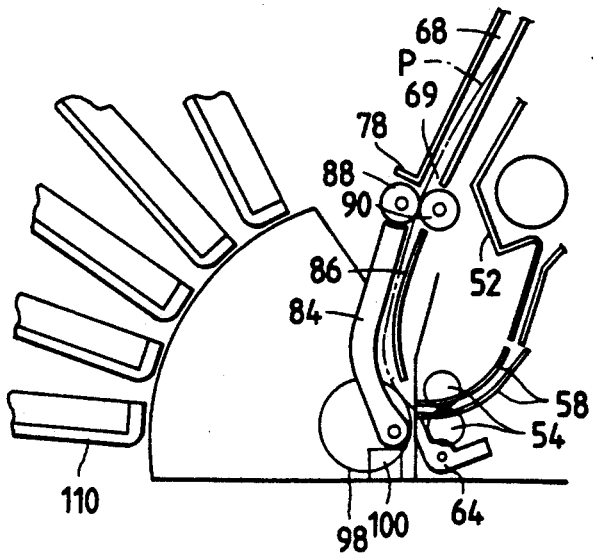

On the other hand, if the double-side printing mode is selected, the printing control unit drives the pulse motor 94 to set the sorter guide members 84, 86 as shown in FIG. 8 so that the head end of the sorter guide members 84, 86 is set to a position confronting with the entrance 69 of the double-side printing path 68. When the recording sheet P whose front side has been printed is discharged from the discharge rollers 54, 54, the recording sheet P changes its direction to upward guided by the sorter guide members 84, 86, and enters the double-side printing path 68 from the entrance 69. Under this condition, the recording sheet P is pushed further upward by the rotation of the sheet forwarding rollers 88, 90 at the end portions of the sorter guide members 84, 86 to cause the head end of the recording sheet P to reach the take-out rollers 74, 76. The recording sheet P is taken upward by the take-out rollers 74, 76 and passes over the recording sheet tail end detector 72. In this instance, a signal is applied from the recording sheet tail end detector 72 to reversely rotate the take-out rollers 74, 76 so that the recording sheet P will be switched back and its tail end will thereby be inserted into the feed inlet 22 of the printing path again by a triangle-shaped forwarding path switching member 77. In this case, the recording sheet is inserted so that its rear side, i.e., the non-printed side, will confront with the photosensitive drum 34. Thus, if the printing data is applied under this condition, the printing process is performed in the same manner as in the front side printing.

Accordingly, the recording sheet whose rear side, has been printed is forwarded to the discharge rollers 54, 54 after being subjected to a toner fixing process by the fixing unit 52, and as a result, a signal is supplied from the sheet detector 60.

Under this condition, the printing control unit sets the recording sheet to the position of the target sheet discharging trays 110 through 118 to which the recording sheet should be discharged by driving the pulse motor 94 and rotating the sorter guide members 84, 86 on the tray side. Thus, the recorded sheet that have been printed on both sides is received by the trays 110 through 118 and sorted by page or by user.

As described above, this embodiment can achieve various functions such as sorting by page, sorting by mail box, inverting the sheet for double-side printing, and discharging the sheet face-up and the like only by changing the position of rotation of a set of sorter guide members 84 and 86.

Figure 9:
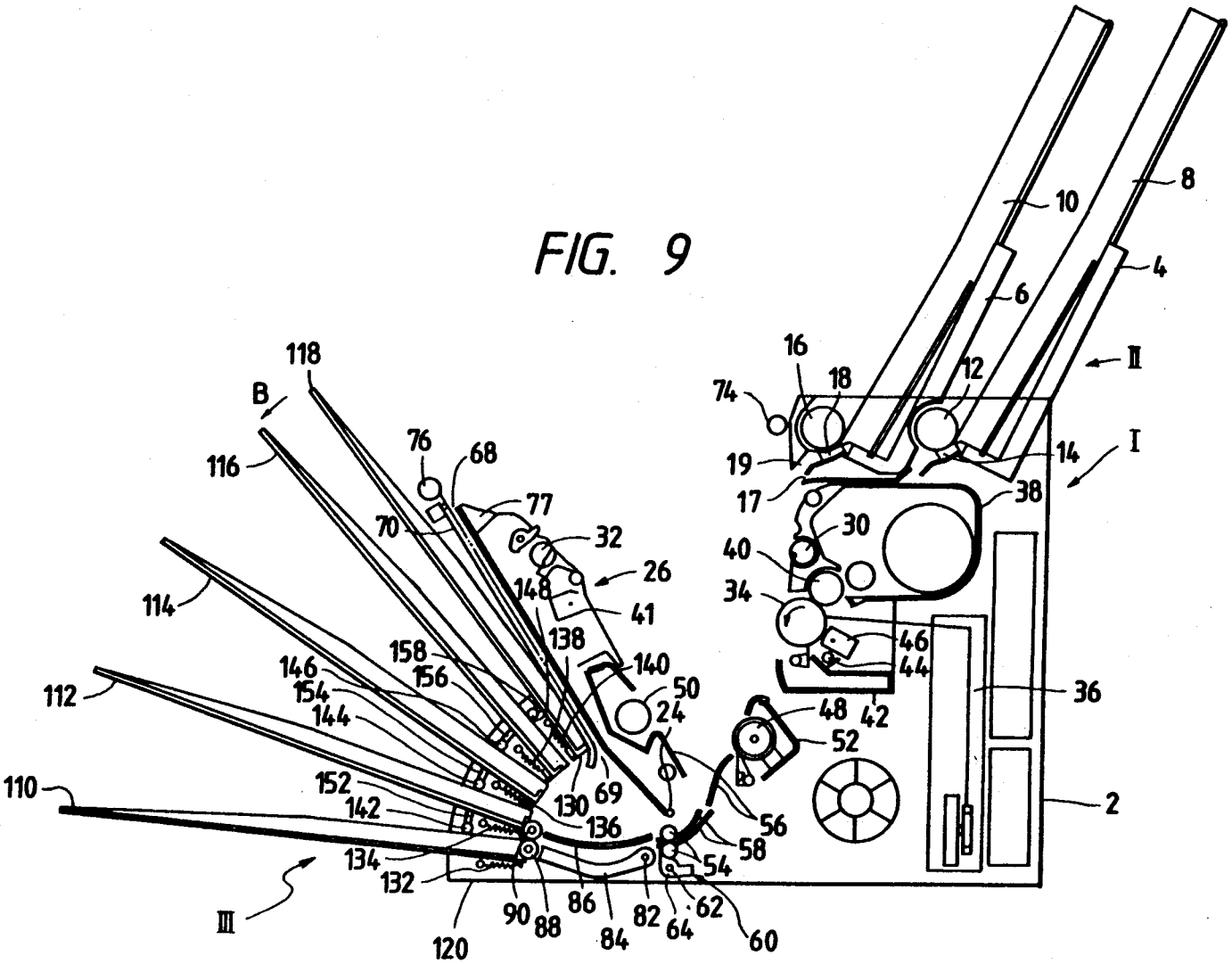
FIG. 9 is a sectional view showing the printer of FIG. 1 with a cover member opened for maintenance.

Further, in the case where the recording sheet is stopped in the printing path on the way of printing process, the cover member 26 of the printer body I can be opened with the rotary shaft 24 as a pivot so that the printing path can be exposed. If further opened under this condition, the cover member 26 is abutted against the tray 118. When the cover member 26 is further pressed down, the tray 118 is folded by being pivoted in the direction of the arrow B in FIG. 9 around a pin 130 resisting the biasing force of a spring 148. Accordingly, the front of the printer body I is exposed, thereby allowing sheet recovering operation or maintenance to be performed easily.

Figure 10:
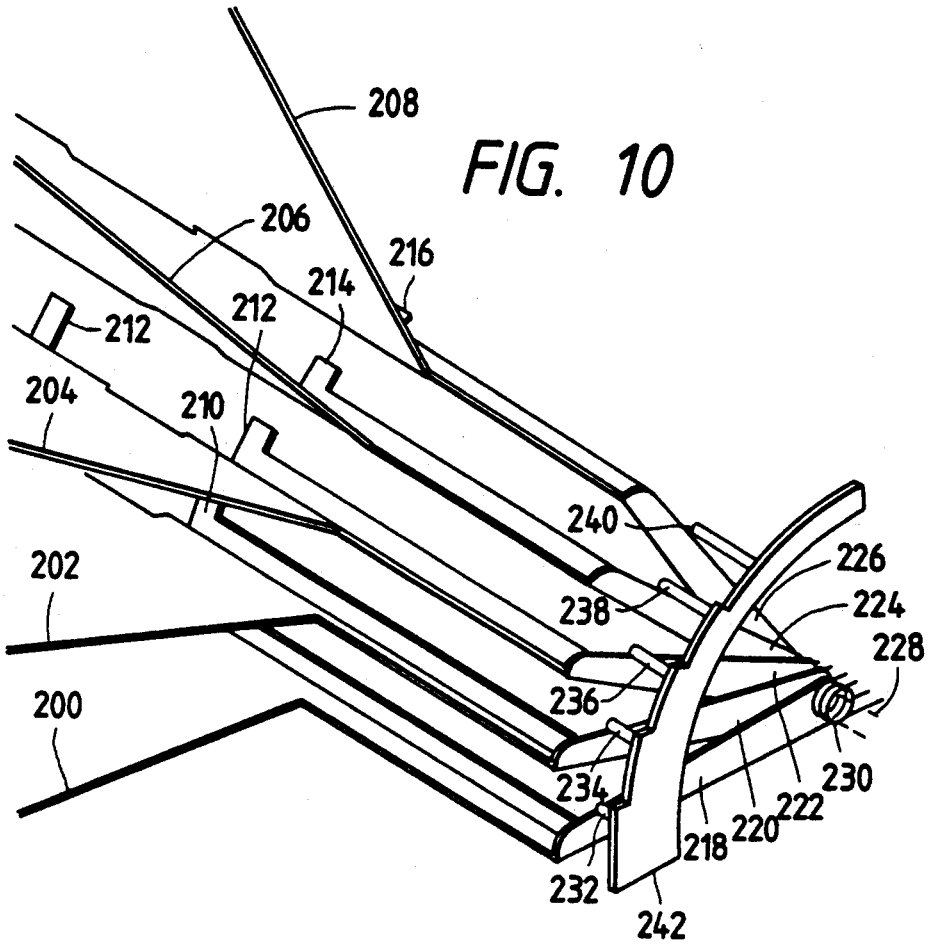
FIG. 10 is a perspective view showing another embodiment of the sorter unit.

FIG. 10 shows a second embodiment of the sorter unit, in which reference numerals 200, 202, 204, 206 and 208 designate sorter trays. Each tray has a specified size with a lower tray having a larger width so that a tray immediately above can be accommodated in a tray immediately below. The tail end of each tray is provided with a sheet stopper 210, 212, 214, or 216 for stopping the recording sheet. These trays 200 through 208 are pivotably supported on the base frame by a shaft 228 through arms 218, 220, 222, 224, and 226 and are biased so that the two adjacent trays will be opened with their end portions being apart wider by a spring 230. On the lateral side of these trays 200 through 208 are angle-adjusting shafts 232, 234, 236, 238, and 240 for determining the degree of tray opening, which are abutted against the lateral ends of the trays 200 through 208 by providing a frame 242.

According to this embodiment, each of the trays 200 through 208 is biased by the spring 230, opened at a predetermined distance by the angle-adjusting shafts 232 through 240 thereby to allow the recording sheet discharged from the printer to be received.

Figure 12:
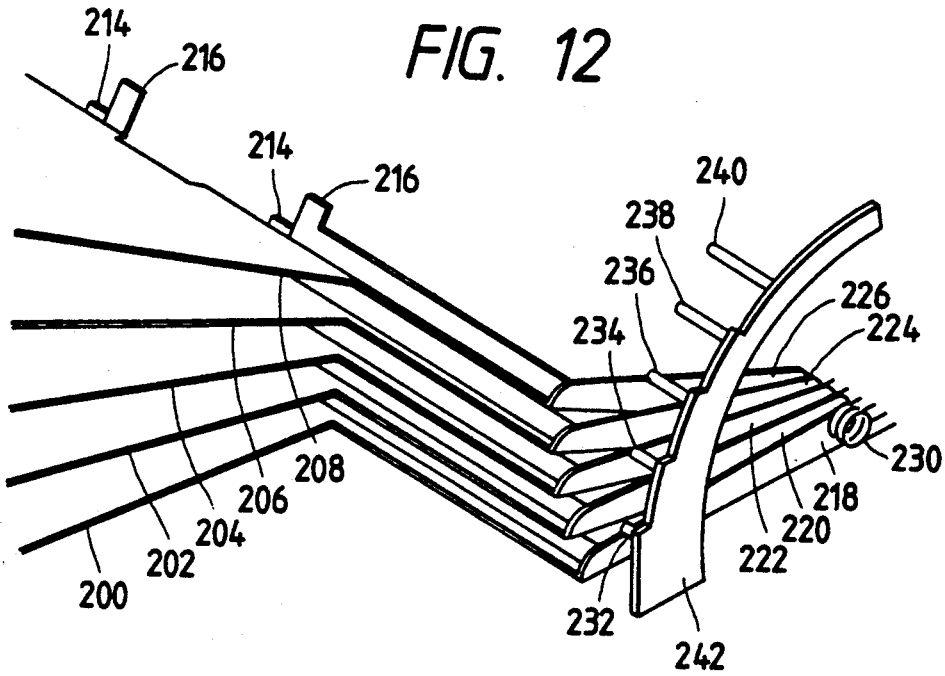
FIG. 12 is a perspective view showing trays folded into the sorter unit under the condition shown in FIG. 11.
Figure 11:
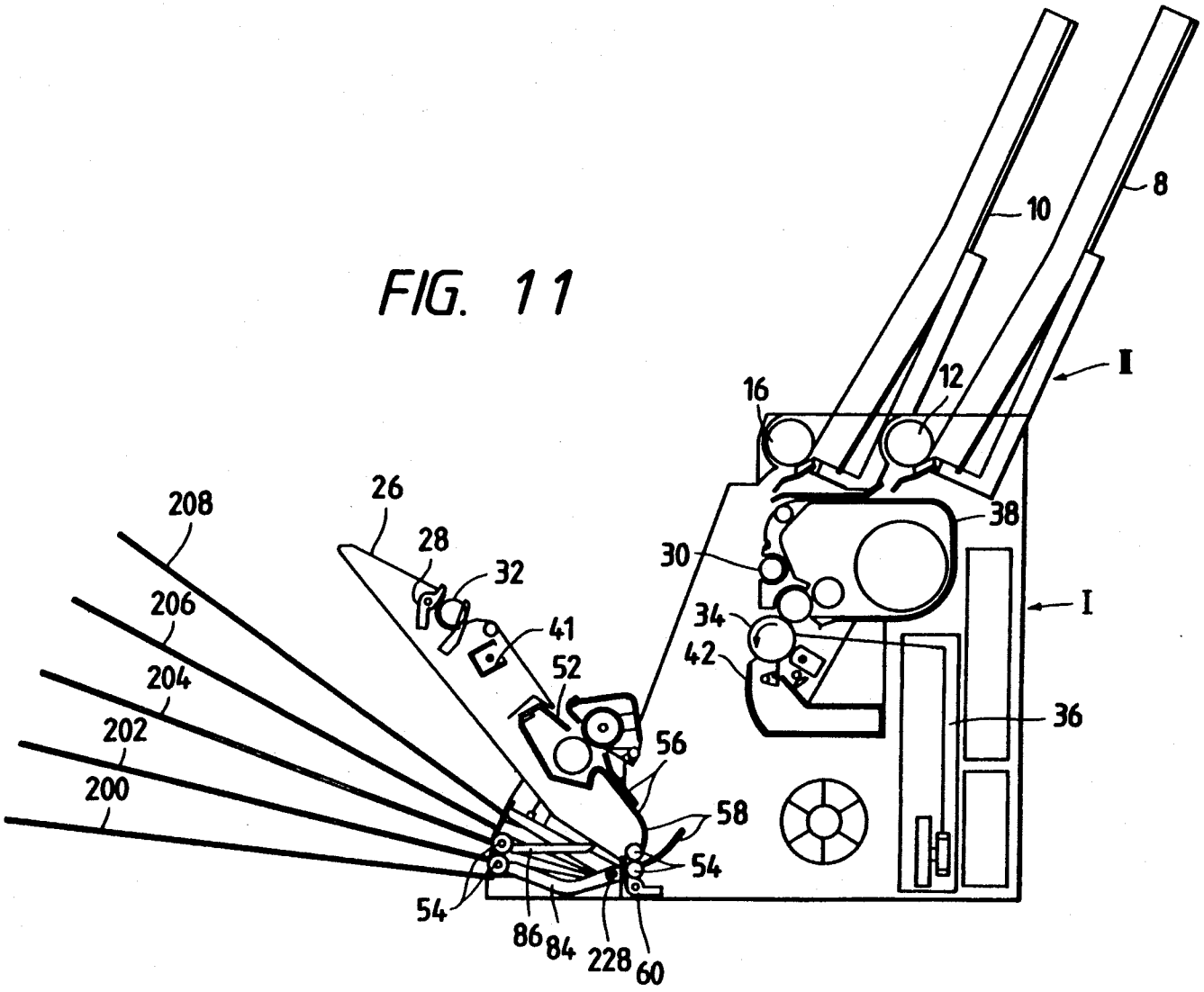
FIG. 11 is a sectional view showing the printer with its cover member opened by assembling the sorter unit shown in FIG. 10 to the printer.

On the other hand, if the cover member 26 of the printer is opened for the recovery of jamming and the maintenance of the printer (FIG. 11) and is abutted against the uppermost portion of the tray 208 thereby to elastically press the tray 208 downward, the tray 208 is pivoted around the shaft 228 resisting the force of the spring 230 and, as shown in FIG. 12, the trays 200 through 208 are folded by being sequentially accommodated by the lower tray, thereby allowing the front of the printer body I to be fully opened for easy handling of the jamming and maintenance.

Figure 13:
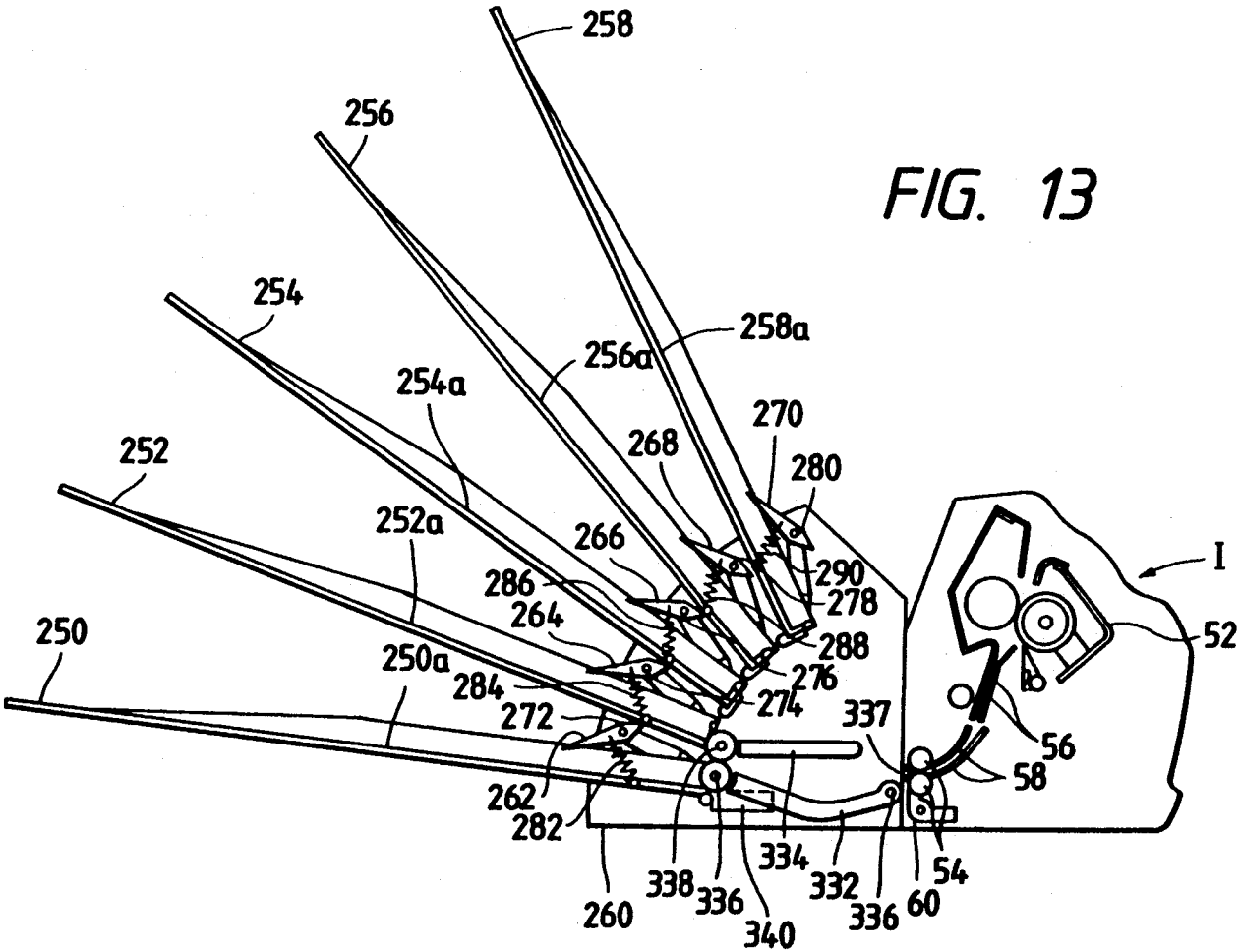
FIG. 13 is a sectional view showing the sorter unit having a detector for detecting the recording sheets reaching a specified level in the tray.
Figure 14:
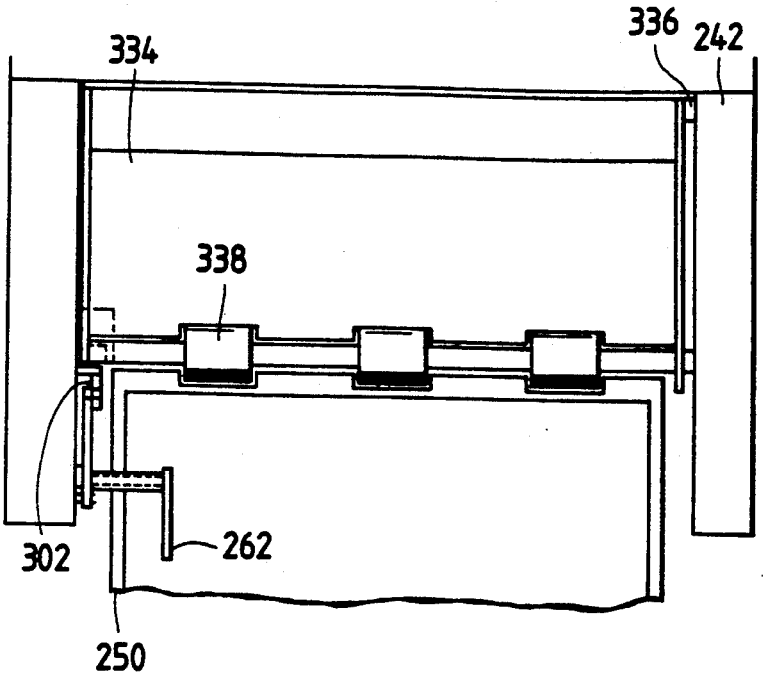
FIG. 14 is a top view for showing the positional relationship of a detection lever.
Figure 15:
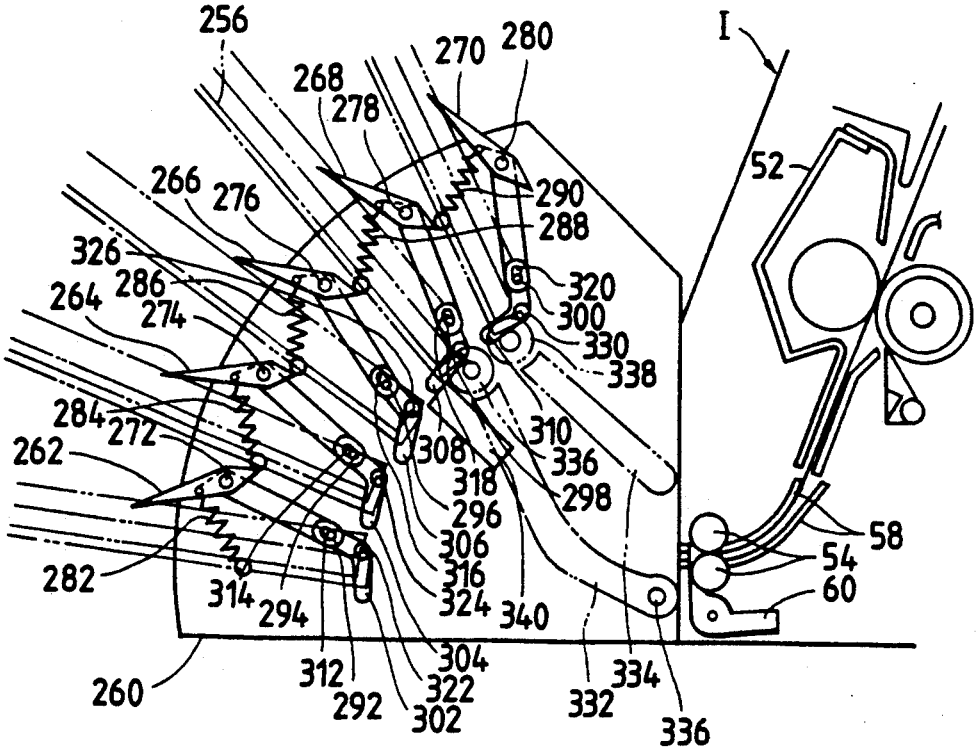
FIG. 15 is a sectional view of the sorter unit with the tray removed to show the arrangement of the detection lever.

FIG. 13 shows an embodiment of a detector for detecting the fullness of recording sheets in the tray. In the figure, reference numerals 250, 252, 254, 256, and 258 designate trays, which are arranged on a base 260 at a predetermined distance from each other so that the recording sheet can be received from sorter guide members 332, 334 for guiding the recording sheet from the discharge rollers of the printer body I. Each of the trays 250 through 258 has a recording sheet detection lever 262, 264, 266, 268, and 270 confronting with the bottom of tray 250*a*, 252*a*, 254*a*, 256*a*, or 258*a* as shown in FIGS. 13 and 14. Each of the levers 262 through 270 is pivotably mounted on the base 260, as shown in FIG. 15, and is always biased by a spring 282, 284, 286, 288, or 290 toward the tray bottom.

Figure 19:
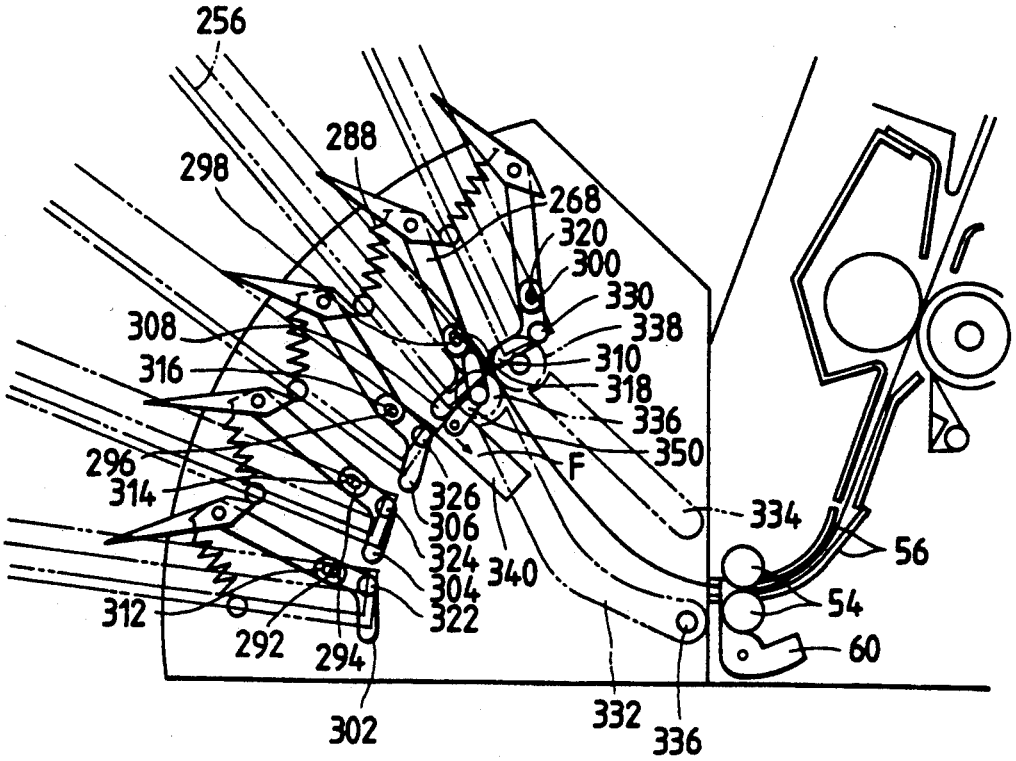
FIG. 19 is a diagram showing a recording sheet having reached the discharge rollers.

As shown in FIG. 19, each of the levers 262 through 270 is engaged with a long hole 312, 314, 316, 318, or 320 of a second lever 302, 304, 306, 308, or 310 through a pin 292, 294, 296, 298, or 230 on the other end. Each of the second levers 302 through 310 is pivotably mounted on a shaft 322, 324, 326, 328, or 330 so that its rotation is linked with the rotation of each of the recording sheet detection levers 262 through 270.

Returning to FIG. 13 again, each of reference numerals 332 and 334 designates the sorter guide member mounted pivotably around the shaft 336 by a drive system (not shown) so that the recording sheet from a discharge outlet 337 of the printer body I is guided into a selected one of the trays 250 through 258. On the end portions of the sorter guide members 332, 334 are provided with discharge rollers 336, 338 connected to the discharger rollers 54, 54 of the printer body I through a transmission mechanism (not shown).

In the figure, a tray-full detector designated by reference numeral 340 is mounted on the end portion of the sorter guide member 332 and confronts with each of the second detection levers 302 through 310 by the movement of the sorter guide members 332, 334.

In this embodiment, after the recording sheet is discharged from the discharge rollers 54, 54 of the printer body I, the recording sheet is then discharged to a selected tray out of the trays 250 through 258 by the sorter guide members 332, 334. In the case where the amount of recording sheets contained in the tray is smaller than the predetermined, the recording sheet detection lever 260, 262, 264, 266 or 268 is held at the initial position by the spring 282, 284, 286, 288, or 290, so that the second lever 302, 304, 306, 308, or 310 never causes the tray-full detector 340 to operate (the state shown in FIG. 15).

Accordingly, every time the sorter guide member 332 or 334 selects one of the trays 250 through 258, the tray-full detector 340 confronts with the second lever 302, 304, 306, 308, or 310 attached to each of the trays 250 through 258.

Figure 16:
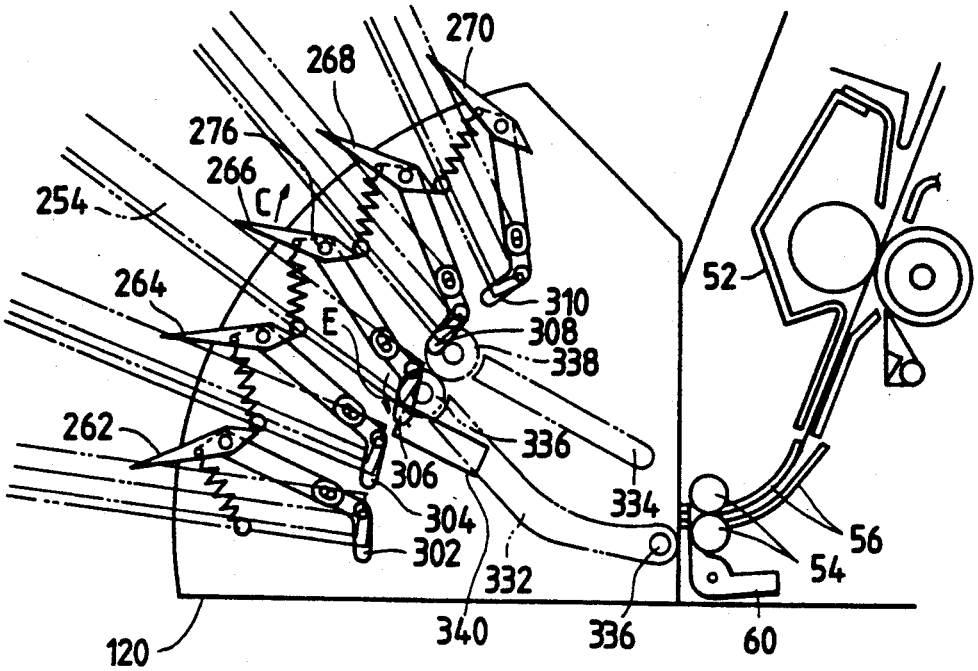
FIG. 16 is a diagram illustrating an operation of the detection lever when a specified amount of recording sheets are contained in the tray.

By the way, when a predetermined tray, e.g., the tray 254, contains a specified amount of recording sheets, the recording sheet detection lever 266 is pivoted in the direction of the arrow C as shown in FIG. 16, thereby causing the second lever 306 to move in association therewith in the direction of the arrow E. As a result, upon selection of the tray 254 by the sorter guide members 332, 334, the second lever 306 belonging to the tray 254 causes the tray-full detector 340 to operate and thereby to apply a signal for informing that the tray 254 is full.

According to this printer, the amount of recording sheets in a plurality of trays can be monitored by one tray-full detector.

Figure 17:
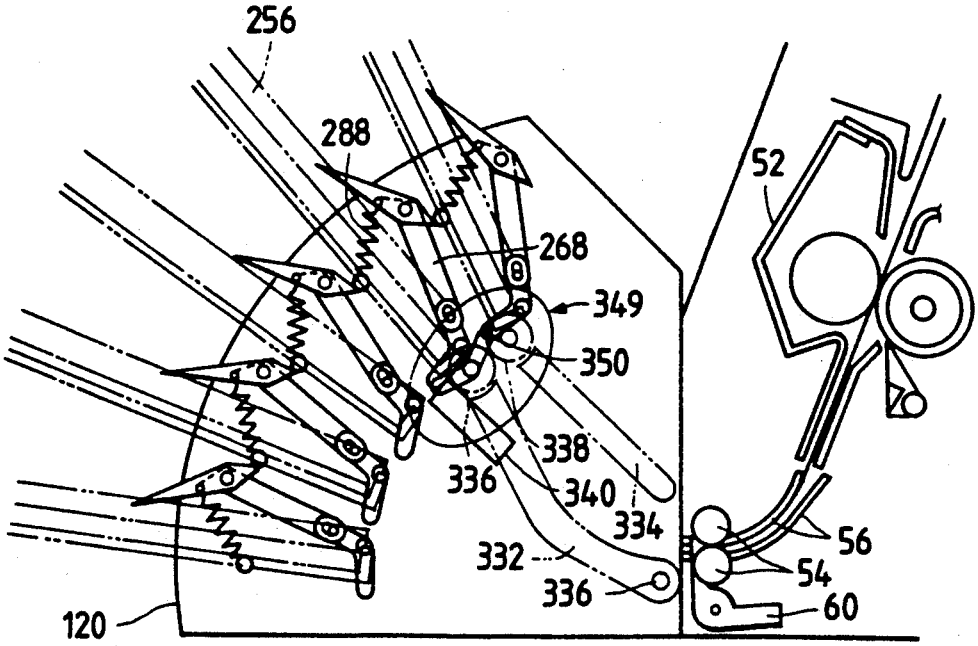
FIG. 17 is a sectional view showing a mechanism for detecting the arrival of a recording sheet at a discharge roller unit of the sorter guide member.
Figure 18:
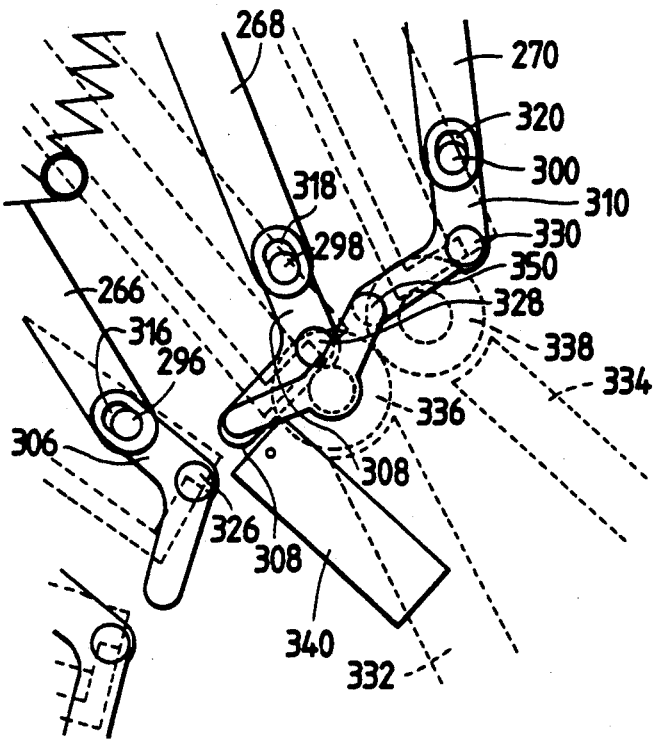
FIG. 18 is a diagram showing a portion designated by reference numeral 349 in FIG. 17 in enlarged state.

FIGS. 17 and 18 show the detection of a jam at the sorter guide members 332, 334 utilizing the tray-full detector 340 shown in FIG. 15. In the figure, reference numeral 350 designates a sheet detection lever mounted on the discharge roller 336 of the sorter guide member 332. The sheet detection lever 350 is normally biased by a spring (not shown) so that the passage formed by the rollers 336 and 338 is interrupted. If the recording sheet is inserted into the rollers 336, 338, the sheet detection lever 350 causes the rollers to rotate so that the recording sheet can pass therethrough.

In this embodiment, if a predetermined tray, e.g., the tray 256 is selected by a drive unit (not shown), the sorter guide members 332, 334 are located at that tray 256. If recording sheets are not full in the selected tray 256 in this instance, the second lever 308 attached to the tray 256 has not yet moved to a position at which the tray-full detector 340 is operated.

When the recording sheet has been discharged from the discharge rollers 54, 54 of the printer body I under this condition, the discharged recording sheet is drawn into the discharge rollers 336, 338 guided by the sorter guide members 332, 334. The sheet detection lever 350 is pressed by the recording sheet and thereby pivoted in the direction of reference character F as shown in FIG. 19 to cause the tray-full detector 340 to operate and to apply a signal. When a forwarding time determined by the size of recording sheet has elapsed, the sheet detection lever 350 is reset to the original position, by which the tray-full detector 340 stops feeding the signal.

On the other hand, when the recording sheet is jammed as caught in the discharge rollers 336, 338, the sheet detection lever 350 remains confronted with the tray-full detector 340, thereby causing the tray-full detector 340 to continuously applying the signal. Accordingly, the user is informed of the occurrence of a jam at the sorter guide members 332, 334.

Figure 20:
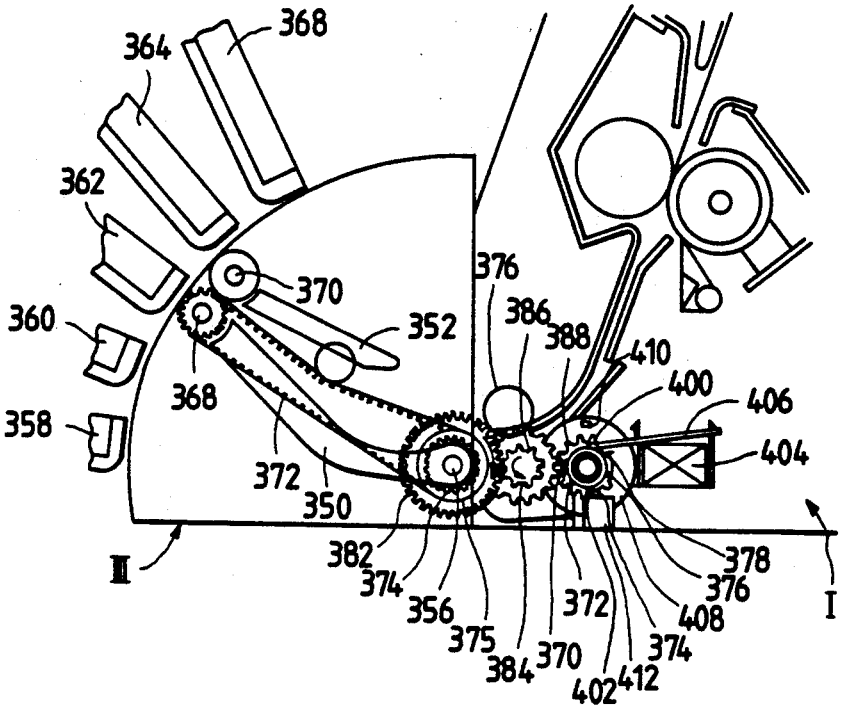
FIG. 20 is a sectional view showing another embodiment of the sorter unit according to the present invention.
Figure 21:
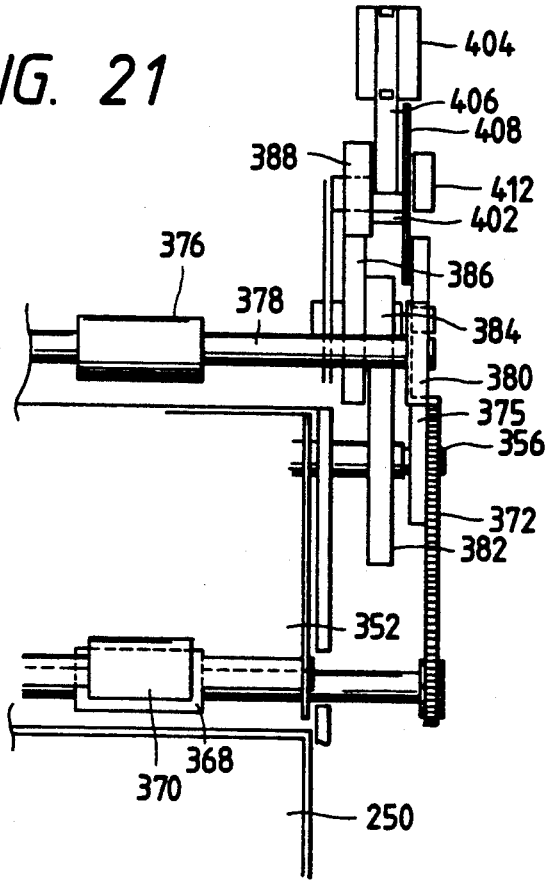
FIG. 21 is a top view showing a drive system of the sorter unit shown in FIG. 20.

FIG. 20 shows another embodiment of the present invention. In the figure, sorter guide members designated by reference numerals 350 and 352 are supported by a shaft arranged on a recording sheet discharge outlet 354 of the printer body I and are rotatably moved around trays 358, 360, 362, 364, and 366 arranged radially around this shaft. The end portions of the sorter guide members are provided with discharge rollers 368, 370 for discharging the recording sheet. One of these discharge rollers, e.g., the discharge roller 368, is connected to a gear 374 freely inserted into a shaft 356 by a timing belt 372. This gear 374 is meshed with a gear 380 secured to a shaft 378 that drives a discharge roller 376 of the printer body I through a gear 375 as shown in FIG. 21, and drives the discharge rollers 368, 370 in response to the driving force from a motor (not shown) for driving the discharge roller 376.

On the other hand, a gear 382 is secured to the shaft 356 to which the sorter guide members 350, 352 are secured, and is connected to a drive gear 388 through intermediate gears 384 and 386 and a gear 382. To this drive gear 388, a ratchet gear 402 having the number of ratchets 390, 392, 394, 396, 398, and 400 corresponding to the number of trays 358 through 366 is coaxially secured. A solenoid designated by reference numeral 404 in the figure is provided with a lever 406 that reciprocates by magnetic attraction and the end portion of the lever 406 is engaged with the ratchet gear 402. A light shielding board designated by reference numeral 408 in the figure is mounted coaxially with the ratchet gear 402 and is adjusted so that a through hole 410 confronts with the photodetector 412 when the sorter guide members 350, 352 are positioned at a specified position; e.g., they confront with the bottommost tray 358.

In this embodiment, when the solenoid 404 is deenergized, the ratchets 390 through 400 of the ratchet gear 402 can freely rotate while getting over the lever 406 because of their oblique surface, the sorter guide members 350, 352 are set to a position at which they confront with the bottommost tray 358 by their own weight. As a result, the through hole 410 of the light shielding board 408 confronts with the photodetector 412, which then applies a signal.

Upon supply of pulsed power to the solenoid 404 under this condition, the lever 406 is attracted toward the ratchet gear 402 by magnetic attraction of the solenoid 404, and presses one of the ratchets 390 through 400. This causes the ratchet gear 402 to rotate by one ratchet thereby to rotate the shaft 356 through the intermediate gears 384, 386 and the gear 382. Accordingly, the sorter guide members 350, 352 move up by one tray.

In this way, a predetermined tray can be selected by supplying pulsed power corresponding to the number of trays which are to be moved from the position where the sorter guide members 350, 352 are currently stopped.

When the tray has been selected in this way and the recording sheet is forwarded to the discharge roller 376 of the printer body I, the recording sheet is guided to the sorter guide members 350, 352 and forwarded to their end portion.

On the other hand, the discharge roller 368 mounted on the end portion of the sorter guide member 350 is being pivoted by the driving force from the discharge roller 376 of the printer body I through the timing belt 372. As the head end of the recording sheet enters the discharge rollers 368, 370 under this condition, the recording sheet is forwarded into the selected tray taken out by the discharge rollers 368, 370. When the tail end of the recording sheet has left the discharge roller 376 of the printer body I in this way, the recording sheet is further taken out by the discharge rollers 368, 370 of the sorter guide members 350, 352 thereby to be received by the tray.

Figure 22:
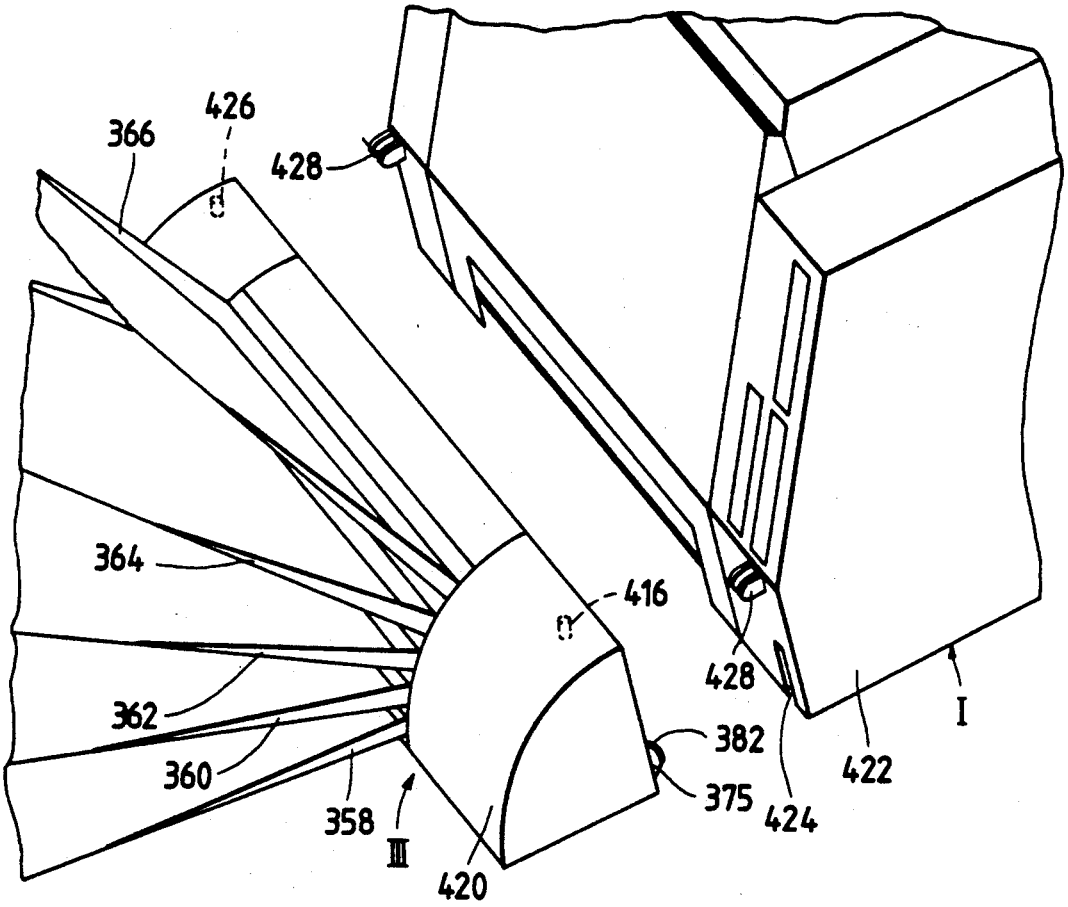
FIG. 22 is a perspective view showing the case where the sorter unit shown in FIG. 20 is constructed so as to be removable.

In this embodiment, the sorter unit III is constructed as a unit independent of the printer body I as shown in FIG. 22, because it is possible to transmit a drive force by the drive mechanism of the printer body I, i.e., the discharge roller drive shaft 378 and the engagement between the intermediate gear 384 and the gear 382. The gear 375 and the gear 382 of the sorter unit protrudes from a base 420. Not only a through hole 424 is provided in a case 422 of the printer body I so as to receive the gears 375, 382 but also engaging members 426 and 428 are provided in the base 420 and the case 422, so that the sorter unit III may be used as an optional component of the printer body I.

That is, to mount a sorter to the printer body I, the gears 375, 382 of the sorter unit III are inserted into the through hole 424 of the printer body I thereby to easily establish a transmission system by the engagement between the gears 375, 382 and the gears 380, 384 of the printer body I.

Figure 23:
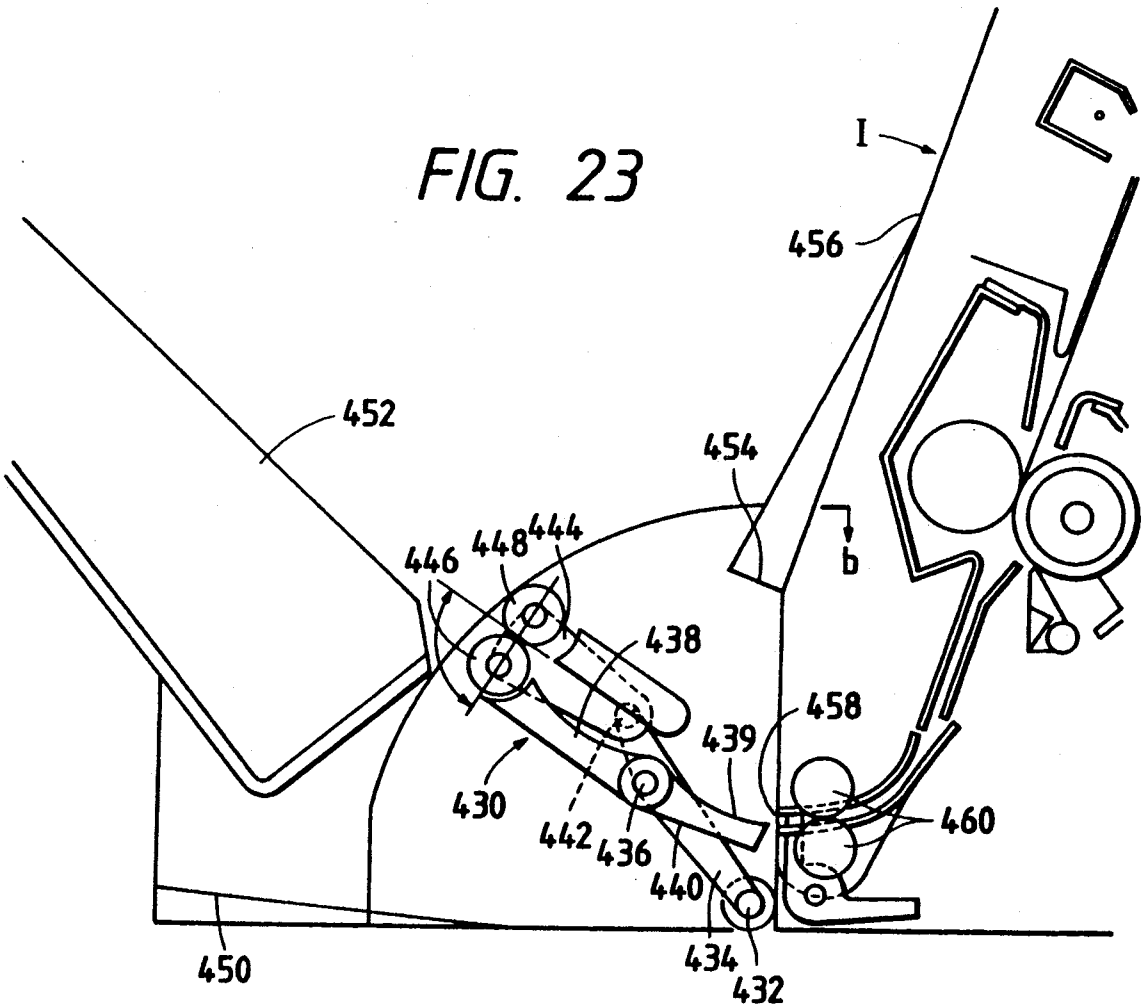

FIG. 23 shows an embodiment of the recording sheet handling mechanism. A recording sheet guide member 430 comprises a first guide board 438 and a second guide board 439 whose end portions are pivotably mounted on a shaft 436 of an arm 434 that is pivotable by a shaft 432. On the end portion of the arm 434 is a frame 444 mounted so as to be pivotable by a shaft 442. The end portion of the frame 444 is provided with discharge rollers 446, 448 that receive a driving force from a prime mover (not shown).

Adjacent to the outside of the rotary locus of the recording sheet guide member 430 are a thick sheet tray 450 at the bottommost layer, a facedown tray 452 at a predetermined angle with respect to the tray 450, and a faceup tray 454 on the surface of a housing 456 of the printer body I.

In this embodiment, to print on an ordinary sheet and accommodate the ordinary sheet in the tray 452 facedown, the angle of the guide boards 439, 438 and arm 434 is adjusted so that the upper surface of the second guide board 439 of the recording sheet guide member 430 will be positioned lower than a discharge outlet 458 of the printer body, the discharger rollers 446, 448 will be positioned higher than the entrance of the facedown tray 452, and the upper surface of the first guide board 438 will connect the second guide board 439 with the discharge rollers 446, 448, as shown in FIG. 23.

When the recording sheet is discharged from the discharge rollers 460, 460 of the printer body I, the head end thereof is moved to the second guide board 439 constituting the recording sheet guide member 430 and to the discharge rollers 446, 448 guided on the upper surface of the first guide board 438. As the head end of the recording sheet enters the discharge rollers 446, 448 in this way, the recording sheet is received by the tray 452 taken out by the discharge rollers 446, 448.

Figure 24:
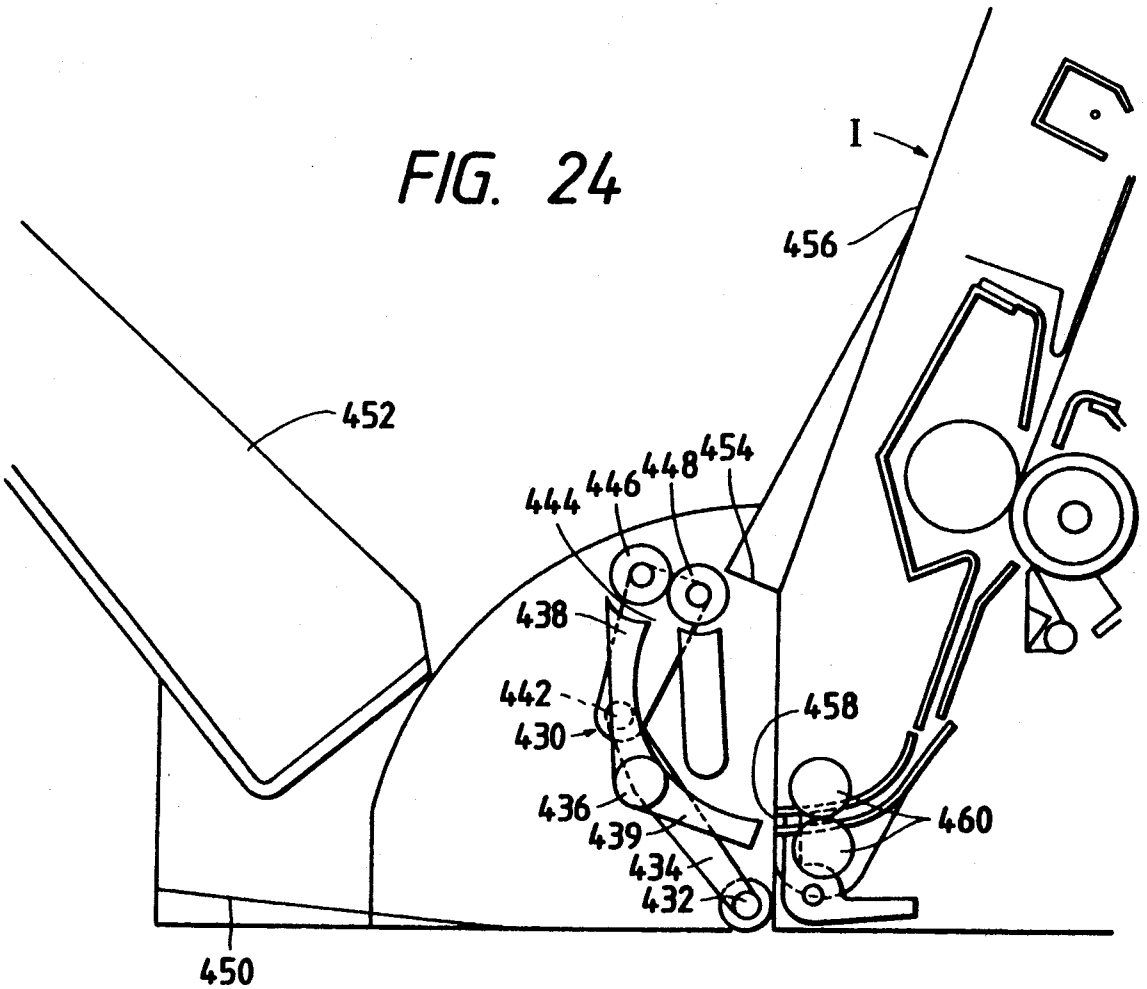
Figure 25:
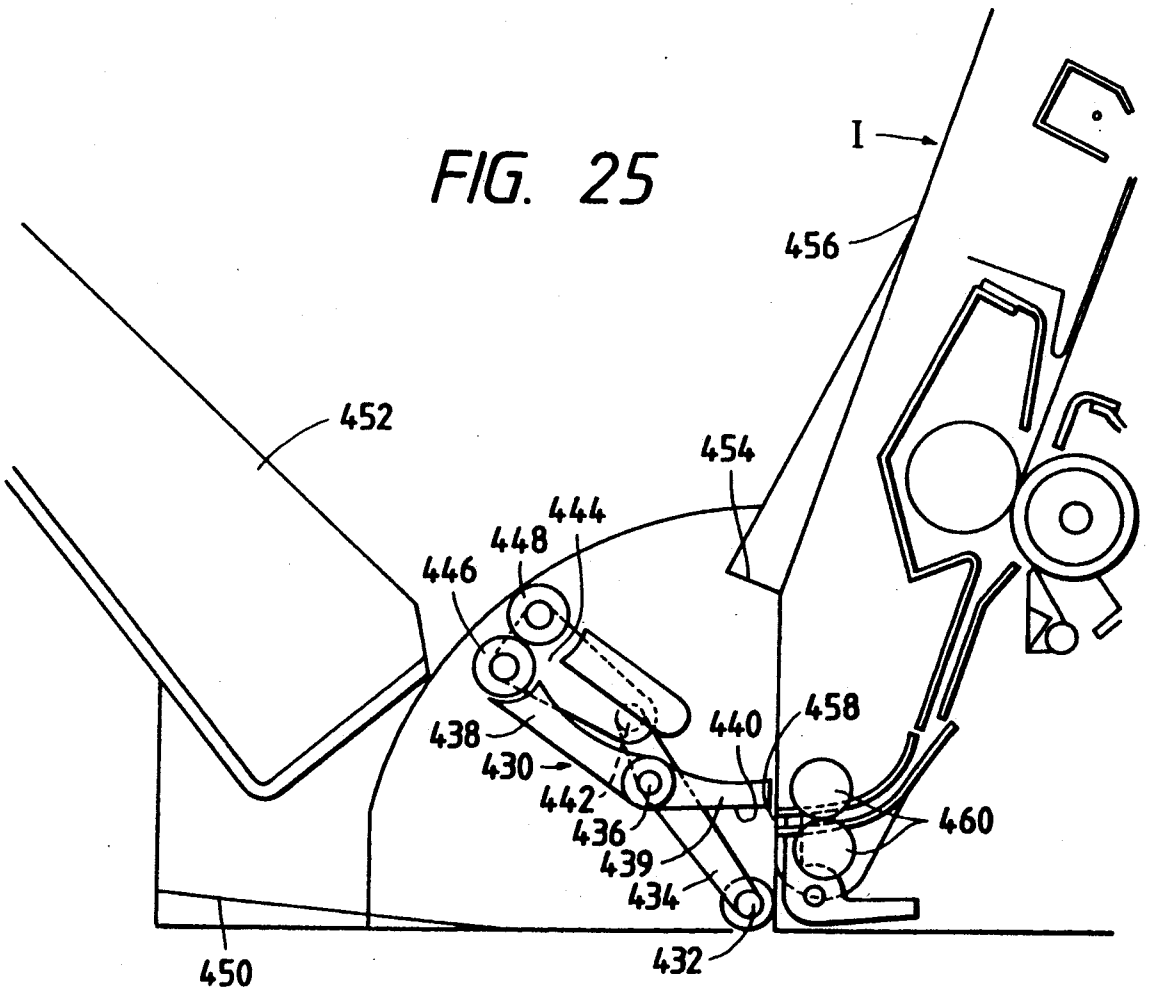

To discharge the recording sheet that has been printed faceup, adjustments are made so that the upper surface of the second guide board 439 is positioned lower than the discharge outlet 458, the second guide board 438 is pivoted to a position at which it is substantially upright, and the tangent of the discharge rollers 446, 448 confronts with the face-up tray 454 by rotating the frame 444 as shown in FIG. 24.

When discharged from the discharge outlet 458 of the printer body I under this condition, the recording sheet is guided through the upper surface of the second guide board 439 and subsequently enters the discharge rollers 446, 448 while bent upward by the first guide board 438. The recording sheet that has entered the discharge rollers 446, 448 is pushed out substantially toward the faceup tray 454, where the recording sheet is accommodated.

To print on a unbendable sheet such as an overhead projector sheet or craft paper, the position of the second guide board 439 is adjusted so that the lower surface 440 of the second guide board 439 will be positioned higher than the discharge roller 458 of the printer body I and the position of the first guide board 438 is adjusted so as to be horizontal.

When a thick sheet is discharged from a recording sheet discharge outlet 459 of the printer body I under this condition, the thick sheet is received by the lowermost thick sheet tray 450 without touching the recording sheet guide member 430.

What is claimed is:

1. A printer comprising:

means for discharging a recording sheet that has been printed by an electrophotographic process, said discharge means having a recording sheet discharge outlet;

a plurality of sorter trays for receiving a plurality of recording sheets that have been printed;

means for guiding a recording sheet from said discharge means to said sorter trays and for discharging said recording sheet to said sorter trays; and means for switching sorters by guiding said sorter guide means to a position of a desired one of said sorter trays;

wherein said sorter guide means is pivotably supported by said sorter switching means, and the center of rotation of said sorter guide means is arranged near said recording sheet discharge outlet of said discharge means;

wherein said sorter trays is provided with a first detection lever which rotates by the weight of said recording sheets accumulated on said sorter trays when a predetermined amount of recording sheets are accumulated on said sorter trays, said sorter trays are provided with a second detection lever which rotates in association with the first detection lever and said sorter guide means is provided with a lever detection means for detecting the movement of said second detection lever; and wherein said sorter guide means is provided with a sheet detection lever which is pressed by said recording sheet to detect a jam of a recording sheet in said sorter guide means, said lever detection means detecting the movement of said sheet detection lever.

* * * * *